United States Patent [19]

Rindt

[11] Patent Number: 4,823,775

[45] Date of Patent: Apr. 25, 1989

[54] APPARATUS FOR TREATING A PATIENT WITH ULTRASONIC WAVES

[75] Inventor: Petrus P. M. Rindt, Delft, Netherlands

[73] Assignee: N.V. Verenigde Instrumentenfabrieken Enraf-Nonius, Netherlands

[21] Appl. No.: 96,316

[22] Filed: Sep. 9, 1987

Related U.S. Application Data

[63] Continuation of Ser. No. 776,745, Sep. 16, 1985, abandoned.

[30] Foreign Application Priority Data

Sep. 14, 1984 [NL] Netherlands ..... 8402845

[51] Int. Cl.[4] ..... A61H 1/00

[52] U.S. Cl. ..... 128/24 A; 310/317

[58] Field of Search ..... 128/24 A; 310/316, 317; 604/22

[56] References Cited

U.S. PATENT DOCUMENTS

| | | | |
|---|---|---|---|
| 2,799,787 | 7/1957 | Guttner et al. | 310/317 |
| 3,447,051 | 5/1969 | Attwood et al. | 310/316 |
| 3,489,930 | 1/1970 | Shoh | 310/316 |
| 3,596,206 | 7/1971 | Loria et al. | 310/316 |
| 3,668,486 | 6/1972 | Silver | 310/316 |
| 3,739,299 | 6/1973 | Adler | 310/317 |
| 3,889,166 | 6/1975 | Scurlock | 310/316 |
| 3,924,335 | 12/1975 | Balamuth et al. | 128/24 A |
| 4,256,987 | 3/1981 | Takeuchi et al. | 310/316 |
| 4,368,410 | 1/1983 | Hance et al. | 128/24 A |
| 4,451,710 | 5/1984 | Taylor et al. | 310/317 |
| 4,587,958 | 5/1986 | Noguchi et al. | 128/24 A |
| 4,621,643 | 11/1986 | New, Jr. et al. | 128/633 |

FOREIGN PATENT DOCUMENTS

| | | | |
|---|---|---|---|
| 0578065 | 10/1977 | U.S.S.R. | 128/24 A |

*Primary Examiner*—Ruth S. Smith

*Attorney, Agent, or Firm*—Kane, Dalsimer, Sullivan, Kurucz, Levy, Eisele and Richard

[57] ABSTRACT

An apparatus for treating a patient with ultrasound waves comprises a treatment head and an amplifier receiving an input signal depending on the desired intensity of the ultrasound waves and providing an electrical output signal on its output. The treatment head can be connected to the output of the amplifier and contains a converter element for converting the electrical signal into ultrasound waves. An adjustable element is provided in the treatment head, the adjustment of which indicates the efficiency and the impedance of the converter element, a controlling circuit being provided for influencing the electrical output signal in dependence on the adjustment of the adjustable element in such a manner that the treatment head delivers ultrasound waves with the desired intensity.

4 Claims, 1 Drawing Sheet

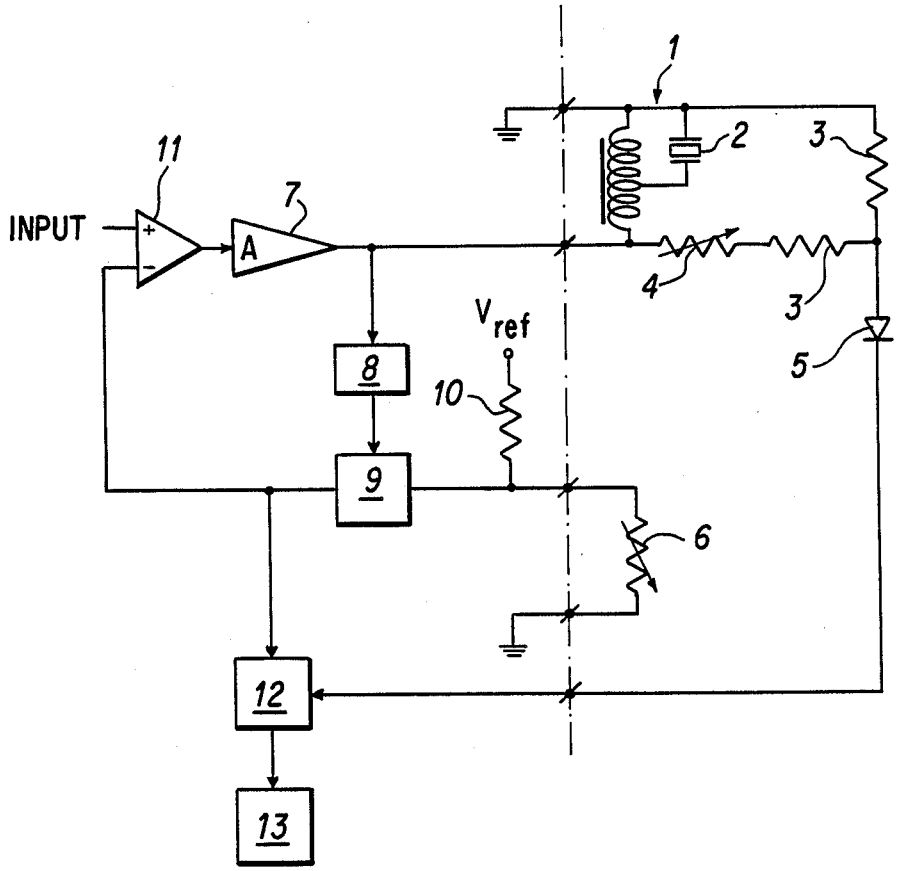
1
2
3
11
7
INPUT
A
4
3
5
$V_{ref}$
8
10
9
6
12
13

APPARATUS FOR TREATING A PATIENT WITH ULTRASONIC WAVES

This application is a continuation of application Ser. No. 776,745, filed Sept. 16, 1985, now abandoned.

The invention relates to an apparatus for treating a patient with ultrasound waves, comprising an amplifier receiving an input signal depending on the desired intensity of the ultrasound waves and providing an electrical output signal on its output, and a treatment head which can be connected to the output of the amplifier and which contains a converter element for converting the electrical signal into ultrasound waves.

The treatment head of such apparatus shows a relatively great variation with respect to the impedance and the efficiency of the converter element. Since the amplifier in the known apparatus at a determined desired intensity of the ultrasound waves delivers a determined quantity of electrical energy, these variations in the parameters of the treatment head will result in variations in the power output of the ultrasound waves, when any given treatment head is connected to the amplifier. Up till now, it is usual to compensate for these variations of the impedance and of the efficiency by adjusting the output signal level of the amplifier during the fabrication in such manner that with a particular treatment head connected to the amplifier effectively the desired intensity of the ultrasound waves is delivered. Thereby, each treatment head may only be used in combination with one determined apparatus adjusted to it, which has various disadvantages. When the user has various apparatuses, the various treatment heads easily may be interchanged so that there is no longer certainty about the power output of the ultrasound waves. When a treatment head becomes defective and has to be replaced, the apparatus has to be adjusted to the new treatment head in situ. The fabricating costs of the known apparatus are high, since the fabrication of the treatment head and the associated apparatus have to be carried out synchronously.

The invention has the object of providing an apparatus of the kind mentioned above, wherein these objections have been overcome in a simple but nevertheless effective manner.

For this purpose, the apparatus of the invention is characterized in that an adjustable element is provided in the treatment head, the adjustment of which indicates the efficiency and the impedance of the converter element, a controlling circuit being provided for influencing the electrical output signal in dependence on the adjustment of the adjustable element in such a manner that the treatment head delivers ultrasound waves with the desired intensity.

In this manner, an apparatus is obtained, which permits any given treatment head to be connected to the amplifier so that for a determined adjusted intensity of the ultrasound waves, notwithstanding various treatment heads varying in impedance and efficiency, a quantity of ultrasound energy is delivered in accordance with the desired intensity. During fabrication of the treatment heads, the adjustable element with the treatment head connected to the output of the amplifier of an apparatus is adjusted in such manner that the intensity of the ultrasound waves delivered by the treatment head is in accordance with the adjusted desired intensity. Thereafter, any treatment head may be connected to any given apparatus, wherein the adjustable element and the controlling circuit provide for a quantity of ultrasound energy delivered to be in accordance with the desired intensity.

The invention also provides a treatment head comprising a converter element included in a circuit for converting an electrical signal into ultrasound waves, characterized by an adjustable element, of which the adjustment indicates the efficiency and the impedance of the converter element.

The invention will be hereinafter explained by way of the drawing schematically showing an embodiment.

In the drawing the parts of the apparatus, which are disposed in a casing and the treatment head, respectively, are separated by a broken line. The part of the apparatus, which is at the left of the broken line in the drawing, is disposed in the casing, whereas the part which is at the right of the broken line in the drawing is disposed in the treatment head. The treatment head in the usual manner can be connected to the remaining part by manner of a plug/socket connector.

The illustrated treatment head is provided with a circuit 1, in which a converter element 2 for converting electric signals into ultrasound waves is included. In parallel to the circuit 1 a voltage divider is connected comprising two fixed resistors 3 and an adjustable resistor 4. The junction between the resistors 3 is accessible through a diode 5. Furthermore, the apparatus includes an adjustable element which, in the illustrated embodiment, is embodied by an adjustable resistor 6.

The remaining part of the apparatus, which is disposed in the casing, is provided with an amplifier 7, of which the output is connected to the circuit including the converter element 2. The output of the amplifier 7 furthermore is connected to a measuring means 8 which measures a parameter of the output signal of the amplifier, for example, the current or the voltage. A signal dependent on this parameter is fed to a first input of a first multiplier 9, of which the second input is connected with the one connection of the adjustable resistor 6, of which the other side is connected to ground. The first mentioned connection of the resistor 6 furthermore is connected to a reference voltage $V_{ref}$ through a resistor 10. The output of the multiplier 9 is connected to the one input of a comparator 11, of which the other input receives a signal dependent on the desired intensity of the ultrasound waves. This intensity can be selected by means of a adjustment means not shown. The output of the comparator 11 is connected to the input of the amplifier 7.

When the treatment head is connected to the casing, the junction between the resistor 3 through the diode 5 is connected to the one input of a second multiplier 12, of which the other input receives the output signal of the first multiplier 9. The output of the multiplier 12 is connected to a display 13.

The operation of the described apparatus is as follows. During the fabrication of the treatment head this head in the indicated manner is connected to the remaining part of the apparatus and the treatment head is placed on a standard phantom for measuring the power output of the ultrasound. The apparatus herein is adjusted to a determined desired intensity of the ultrasound waves. Thereafter, the resistor 6 is adjusted so that the power output of the treatment head effectively corresponds with the desired power as adjusted on the apparatus. The adjustment of the resistor 6 then indicates the efficiency and the impedance of the converter element 2. This adjustment of the resistance 6 determines the voltage which prevails at the junction between the resistance 10 and the resistor 6. Via the measuring means 8, the multiplier 9 and the comparator 11, which together form a controlling circuit, the driving of the amplifier 7 by the voltage on this junction between the resistors 6 and 10 is influenced so that an electrical signal is fed to the treatment head, which signal is converted into ultrasound waves of the desired intensity by the converter element 2.

Thereupon, the adjustable resistor 4 is adjusted, so that the real power output appears on the display 13. During the use of the treatment head, the real power output delivered to a patient still may vary due to a varying temperature, a varying area of contact with the patient and the like so that such variation can be read from the display 13.

Once the adjustment of the resistors 4 and 6 of the treatment head has taken place, any given treatment head may be used with the described apparatus, since under all circumstances through the said controlling circuit the driving of the amplifier 7 will be adapted to the efficiency and the impedance of the converter element 2 of the respective treatment head. Thereby, a defective treatment head without problems may be replaced by a new treatment head without a need for adjusting the apparatus with the user. The treatment heads of various apparatuses may be interchanged without objection. The fabricating costs of the described apparatus may be reduced, since the treatment heads and the remaining part of the apparatus may be separately fabricated as required.

The invention is not limited to the embodiment described above, which may be varied within the scope of the invention in various manners.

For example, the second input of the multiplier 9 may be suitably coupled to the junction between the resistors 3 so that the treatment head also at varying temperature or varying area of contact with the patient continuously will deliver a constant power output to the patient.

I claim:

1. Apparatus for treating a patient with ultrasound waves, comprising:

means for receiving an electrical signal of ultrasonic frequency and adjustable amplitude;

an amplifier having an input and an output, the input receiving an input signal from the receiving means depending upon a desired intensity of the ultrasound waves and the output providing an output electrical signal, a treatment head, means for detachably connecting the treatment head to the output of the amplifier, said treatment head having a converter element with means for converting the electrical output signals into ultrasound waves and an adjustable element with means for indicating the efficiency and the impedance of the converter element, wherein the apparatus further includes a controlling means having first and second inputs and an output, the first input being connected to the amplifier output, wherein said connecting means connect the adjustable element to the second input of the controlling means, said controlling means output being coupled to the amplifier to control the electrical output signal in dependence on the adjustment of the adjustable element.

2. Apparatus according to claim 1, wherein the controlling means comprises a measuring means connected to said first input for measuring a parameter of the electrical output signal of the amplifier, a first multiplier having first and second inputs and an output, said multiplier first input receiving an output signal of said measuring means depending on said parameter, the second multiplier input being the second input of the controlling means, and a comparator having first and second inputs and an output, said first comparator input being connected with the multiplier output, said second comparator input being connected with the adjusting means and said comparator output being connected with the amplifier input.

3. Apparatus according to claim 2, wherein the adjustable element of the treatment head comprises an adjustable resistor having two ends;

said connecting means connecting said adjustable resistor between the second input of the controlling means and ground, a reference voltage source being provided, which reference voltage source is connected to the second input of the controlling means through a resistor.

4. Apparatus according to claim 2 wherein the treatment head comprises a voltage divider with a branching point, which is connected to a rectifier element, said voltage divider having an adjustable resistor and being connected in parallel to a circuit including the converter element, the apparatus further comprising a second multiplier, and a display, said second multiplier having first and second inputs and an output, wherein said connecting means connects the rectifier element to the first input of the second multiplier, the second input of the second multiplier being connected to the output signal of the first multiplier and the output of said second multiplier being connected to said display.

* * * * *